US010009976B2

(12) United States Patent
Aristizabal et al.

(10) Patent No.: US 10,009,976 B2
(45) Date of Patent: Jun. 26, 2018

(54) ELECTROLUMINESCENT DEVICE AND MANUFACTURING METHOD THEREOF

(71) Applicant: CENTRO DE INOVAÇÕES CSEM BRASIL, Belo Horizonte, MG (BR)

(72) Inventors: Sergio Lopera Aristizabal, Belo Horizonte (BR); Jose Maria Anacleto Luz Junior, Belo Horizonte (BR); Peter Levermore, Darmstadt (DE)

( * ) Notice: Subject to any disclaimer, the term of this patent is extended or adjusted under 35 U.S.C. 154(b) by 137 days.

(21) Appl. No.: 15/102,401

(22) PCT Filed: Dec. 8, 2014

(86) PCT No.: PCT/IB2014/002705

§ 371 (c)(1),
(2) Date: Jun. 7, 2016

(87) PCT Pub. No.: WO2015/082992

PCT Pub. Date: Jun. 11, 2015

(65) Prior Publication Data

US 2016/0316540 A1 Oct. 27, 2016

(30) Foreign Application Priority Data

Dec. 7, 2013 (GB) ..... 1321639.5

(51) Int. Cl.
*H05B 33/14* (2006.01)
*H05B 33/12* (2006.01)
(Continued)

(52) U.S. Cl.
CPC ..... *H05B 33/145* (2013.01); *H05B 33/10* (2013.01); *H05B 33/12* (2013.01); *H05B 33/14* (2013.01);
(Continued)

(58) Field of Classification Search
CPC ..... H05B 33/145; H05B 33/10; H05B 33/12; H05B 33/14; H05B 33/22; H05B 33/26; H05B 33/28
See application file for complete search history.

(56) References Cited

U.S. PATENT DOCUMENTS

2007/0182677 A1 8/2007 Lee et al.
2010/0047944 A1 2/2010 Kim
(Continued)

FOREIGN PATENT DOCUMENTS

CN 102931307 A 2/2013
GB 2284699 A 6/1995
(Continued)

OTHER PUBLICATIONS

International Search Report and Written Opinion received for International Patent Application No. PCT/IB2014/002705, dated Apr. 20, 2015, 8 pages.
(Continued)

*Primary Examiner* — Anne Hines
(74) *Attorney, Agent, or Firm* — John J. Elnitski, Jr.

(57) ABSTRACT

A method of manufacturing an electroluminescent device including at least one region that is operable to emit light when excited by an electric signal being applied thereto is provided. Layers of electrode material and light-emitting material are deposited to form a multi-layer structure. During deposition, one or more of the layers are at least partially dried or cured before adding a subsequent layer. Once the multi-layer structure is formed, heat is applied to the multi-layer structure to soften one or more of its layers. Thereafter, an optionally non-planar molding surface is applied to the softened multi-layer structure to form at least one region with substantial two-dimensional curvature. At least one light-emitting layer within said region is operable to emit light in a spatially continuous manner with substantially uniform luminance and chromaticity across said region.

20 Claims, 5 Drawing Sheets

(51) Int. Cl.

| | |
|---|---|
| ***H05B 33/22*** | (2006.01) |
| ***H05B 33/26*** | (2006.01) |
| ***H05B 33/10*** | (2006.01) |
| ***H05B 33/28*** | (2006.01) |

(52) U.S. Cl.
CPC ..... *H05B 33/22* (2013.01); *H05B 33/26* (2013.01); *H05B 33/28* (2013.01)

(56) References Cited

U.S. PATENT DOCUMENTS

| | | | | |
|---|---|---|---|---|
| 2010/0171138 | A1 | 7/2010 | Yamazaki et al. | |
| 2015/0049127 | A1* | 2/2015 | Masumoto | H01L 51/56 345/690 |
| 2016/0359143 | A1* | 12/2016 | Osawa | H01L 51/5278 |

FOREIGN PATENT DOCUMENTS

| | | | |
|---|---|---|---|
| GB | 2391686 | A | 2/2004 |
| JP | 2009-176589 | A | 8/2009 |
| WO | 2015/082992 | A1 | 6/2015 |

OTHER PUBLICATIONS

Combined Search and Examination Report received for United Kingdom Patent Application No. GB1321639.5, dated Jun. 11, 2014, 7 pages.
Examination Report received for United Kingdom Patent Application No. GB1321639.5, dated Mar. 1, 2016, 5 pages.

* cited by examiner

ELECTROLUMINESCENT DEVICE AND MANUFACTURING METHOD THEREOF

TECHNICAL FIELD

The present disclosure relates generally to electroluminescent devices; and more specifically, to electroluminescent devices including one or more regions of substantial two-dimensional curvature that are operable to emit light when excited by an electric signal being applied thereto. Moreover, the present disclosure relates to methods of manufacturing the aforesaid electroluminescent devices. Furthermore, the present disclosure also relates to manufacturing apparatus for manufacturing the aforesaid electroluminescent devices.

BACKGROUND

Many types of conventional light sources are known, examples of which include, but are not limited to, incandescent light sources, fluorescent light source, lasers, gas discharge light sources, chemical light sources, and electroluminescent light sources. In electroluminescent light sources, materials emit light in response to an electric current or an electric field being applied thereto. Moreover, electroluminescent (EL) light sources represent a broad category of light sources, such as light-emitting diodes (LEDs), organic light-emitting diodes (OLEDs), polymer light-emitting diodes (PLEDs), which are a subset of OLEDs, light-emitting electrochemical cells (LECs), field-induced polymer electroluminescent lamps (FIPELs), thick film electroluminescent (TFEL) lamps, thin film electroluminescent lamps, and electroluminescent wires.

Thick film electroluminescent lamps, thin film electroluminescent lamps and electroluminescent wires typically include one or more layers of phosphor crystals that emit light in response to an electric field being applied thereto. The electric field being applied is usually an alternating electric field having an alternating frequency in order of 1 kHz. In simple terms, thick film electroluminescent lamps, thin film electroluminescent lamps and electroluminescent wires can be regarded as various forms of light-emitting capacitors (LECs). For light to be generated from a light-emitting capacitor (LEC), its electrodes must be connected in a manner so that the electric field can be applied to the phosphor crystals. The electric field is conveniently generated using an inverter, which is typically configured to deliver an alternating current (AC) sine wave excitation signal to the LEC; optionally, excitation with temporally abruptly-changing waveforms can be applied, for example, "square waves". A voltage and a frequency of the applied excitation signal influence brightness and operating lifetime of the LEC, wherein up to a certain saturation point, higher voltage and higher frequency both result in higher LEC brightness, but reduced operating lifetime. Preferably, an AC sine wave signal is applied, wherein a gradual change of electric field associated therewith is less harsh on the phosphor crystals than abrupt changes occurring in an electric field resulting from applying a square wave signal to the phosphor crystals, as aforementioned.

As previously mentioned, LECs are often divided into three different categories: thick film electroluminescent (TFEL) lamps, thin film electroluminescent lamps and electroluminescent wires. TFEL lamps are typically characterized by layer thicknesses in a range of 1 μm to 100 μm, and are typically fabricated using wet printing techniques. Thin film electroluminescent lamps are typically characterized by layer thicknesses of less than 1 μm, and are typically fabricated using vacuum deposition techniques. Depending upon the intended application, TFEL lamps are typically operated at a frequency in a range of 400 Hz to 1500 Hz, and excited by a signal having route-mean-square (RMS) value in a range of 60 volts to 120 volts. Operation at higher frequency and/or voltage is possible, but with correspondingly shorter lifetime and diminishing gains in brightness.

Further, the LECs operate on fundamentally different operating principles as compared to other EL light sources. For example, OLED-based EL light sources allow electric current to flow therethrough, as they operate with bias; however, LECs operate based on charge/discharge cycles. Typically, LECs include a front electrode layer, a rear electrode layer, a dielectric insulating layer and a micro-encapsulated solid phosphor layer. In operation, when an alternating current is applied to the front and rear electrode layers, an electromagnetic field is created. This electromagnetic field in turn excites the phosphor layer which produces a luminous energy.

Some advantages and disadvantages of LEC lamps are provided in a table below.

| Advantages of LEC Lamps | Disadvantages of LEC Lamps |
|---|---|
| Lightweight | Low luminance light source, luminance of less than 300 candela per square meter |
| Thin | Limited range of emission colours |
| Flexible | Require a customized power supply, such as an inverter |
| Cool-to-touch | Energy inefficient light source, luminous efficacy of less than 10 lumens per watt |
| Devoid of glass to break | |
| Devoid of gas to escape | |
| Uniform light emission over a large area | |
| Simple to install | |
| Simple to maintain | |
| Compatible with roll-to-roll (R2R) manufacturing method | |

Electroluminescent light sources, in general, and more specifically, LEC lamps and TFEL lamps, can be routinely fabricated on lightweight, thin and flexible substrates, such as polycarbonate, polyethylene teraphthalate (PET) or polyethylene naphthalate (PEN), using vacuum deposition and/or wet-process deposition techniques. A typical commercial example is Light Tape, manufactured by Electro-LuminX Lighting Corporation. These flexible TFEL lamps can be flexed with one-dimensional (1D) curvature and wrapped around various objects. However, more complex shapes cannot be covered using conventional TFEL lamps. For many applications, it is desirable that a TFEL lamp has substantial curvature in two dimensions (2D). Examples of shapes with surfaces with 1D curvature are cylinders and cones. These shapes have surfaces with zero Gaussian curvature and are developable. In other words, these surfaces can be flattened out onto a plane without distortion. Examples of shapes with surfaces with 2D curvature are spheres, spheroids, partial spheroids, three-dimensional saddles and depressions. These shapes have surfaces with non-zero Gaussian curvature and are non-developable. In other words, these surfaces cannot be flattened out onto a plane without distortion.

From this description, it is clear that electroluminescent light sources prepared on planar substrates cannot be conformed to have 2D curvature without distortion of their plane. The problem is that distortion of a plane within an emissive region can cause critical damage to light-emitting layers and/or complimentary device layers, such that an electroluminescent light source may cease to function, or function with reduced efficiency and/or uniformity. The typical cause of this critical damage is cracking or delamination of the light-emitting layers and/or the complimentary device layers that can lead to open and/or short circuits and/or increased sheet-resistance within these layers In particular, for electroluminescent light sources, such as OLEDs, PLEDs and LECs, transparent electrodes, which are most typically fabricated from Indium Tin Oxide (ITO), are well known to suffer from cracking. This is described in relation to TFEL lamps and problems caused by distortion in a published PCT patent application WO2001/010571A1, entitled "Printable Electroluminescent Lamps Having Efficient Material Usage and Simplified Manufacture Technique".

In an attempt to circumvent this problem, various conventional techniques have been employed. One conventional technique, related to TFEL lamps, has been described in U.S. Pat. No. 6,054,809 to Bryan D. Haynes, et al., entitled "Electroluminescent Lamp Designs". This conventional technique involves patterning emissive areas around regions of substantial 2D curvature, such that there are no substantial 2D curvature in the emissive areas, but only in-between the emissive areas. However, this conventional technique suffers from several disadvantages. Firstly, extra steps required for patterning the emissive area are complex and time-consuming. Secondly, these extra steps increase an overall cost of manufacturing. Thirdly, the conventional technique does not enable continuous regions of light emission across regions of 2D curvature, thereby limiting visual effect and range of applications.

Another conventional technique, related to OLED lamps, has been described in US patent application no. 20120161610, entitled "Light Extraction Block with Curved Surface", and US patent application no. 20120162995, entitled "3D Light Extraction System with Uniform Emission Across". This conventional technique involves use of additional optical components to create an appearance of 2D curvature of a region. In this conventional technique, a light extraction block, with an external surface with 2D curvature that optionally includes a light-scattering layer, is optically coupled to a planar OLED device. When operated, light generated in the planar OLED device propagates into the light extraction block, wherefrom the light is scattered by the external surface with 2D curvature, giving a visual effect of a continuous light source with 2D curvature. However, in this instance, one or more device layers, where photons are generated and from where the light is emitted initially, are planar, optionally with 1D curvature, but not with 2D curvature. The visual effect is created only through the use of the additional optical components, namely, the light extraction block with the light-scattering layer. However, this conventional technique suffers from several disadvantages. Firstly, the additional optical components are complex, and add bulk to the light source, thereby limiting range of applications. Secondly, the additional optical components are expensive.

Yet another conventional technique is described in U.S. Pat. No. 6,926,972 B2 to Michael Jakobi, et al., entitled "Method of Providing an Electroluminescent Coating System for a Vehicle and an Electroluminescent Coating System Thereof". This conventional technique involves applying electroluminescent coatings, in particular, to automobiles, using spray-coating techniques. Although not described in the U.S. Pat. No. 6,926,972 B2, it is feasible that the technique provided therein could be applied to coating electroluminescent layers onto surfaces with substantial 2D curvature. However, it has yet to be demonstrated that this can be done uniformly with high precision required to achieve a desired uniformity of luminance and/or chromaticity. This is because a TFEL lamp acts as a light-emitting capacitor (LEC) in which a layer thickness variation of as little as 1 μm to 5 μm can lead to noticeable differences in light source luminance and/or chromaticity.

In light of the foregoing, there exists a need for a method of manufacturing an electroluminescent device that is operable to emit light in a substantially uniform manner with substantially uniform luminance and chromaticity.

BRIEF SUMMARY

The present disclosure seeks to provide an improved light-emitting capacitor (LEC) device including at least one light-emitting layer, within at least one region with substantial curvature in two dimensions (2D) and maintain layer thickness uniformity across the at least one region of substantial curvature, that is operable to emit light across the at least one region. The electroluminescent devices, materials and manufacturing methods disclosed herein offer an improvement over the prior art in that they allow for spatially continuous generation and emission of light across one or more regions with 2D curvature.

Moreover, the present disclosure seeks to provide an improved method of manufacturing the aforesaid improved light-emitting capacitor (LEC), such that additional patterning steps or optical components are not required.

Furthermore, the present disclosure seeks to provide a light-emitting capacitor (LEC) device that is operable to emit light in a manner with substantially uniform luminance across one or more regions with 2D curvature. The luminance uniformity measured across a surface of at least one of the one or more regions is greater than 80%.

Furthermore, the present disclosure seeks to provide a light-emitting capacitor (LEC) device that is operable to emit light in a manner with substantially uniform chromaticity across one or more regions with 2D curvature. The variations in chromaticity ($\Delta(u', v')$) measured across a surface of at least one of the one or more regions are less than 0.02.

According to a first aspect, there is provided a light-emitting capacitor (LEC) device that is operable to emit light from one or more regions thereof. These regions include one or more multi-layer structures comprising one or more light-emitting layers disposed between a plurality of electrode layers. These electrode layers are operable to receive in operation an excitation signal to apply an electric signal to the light-emitting layers.

The regions have substantial curvatures in two dimensions. The light-emitting layers are operable to emit light in a spatially continuous manner with substantially uniform luminance and chromaticity across the regions.

The light-emitting capacitor (LEC) device is capable of providing enhanced performance when in operation, in respect that light can be generated substantially uniformly across regions with substantial two-dimensional curvatures.

Optionally, the light-emitting capacitor (LEC) device is a thick film electroluminescent (TFEL) device.

Optionally, for the light-emitting capacitor (LEC) device, at least a portion of the regions has a shape pursuant to at least one of: an at least partially hemispherical shape, an at least partially spherical shape, an at least partially spheroid shape, an at least partially saddle shape, or ordered or disordered arrays of any of these shapes.

Optionally, for the light-emitting capacitor (LEC) device, at a given point 'P' on a surface of at least one of the regions, a major principal radius of curvature '$k_1$' is in a range of 1 mm to 500 mm and a minor principal radius of curvature '$k_2$' is in a range of 1 mm to 500 mm. The major principal radius of curvature '$k_1$' is defined as a maximum radius of curvature, while the minor principal radius of curvature '$k_2$' is defined as a minimum radius of curvature. A radius of curvature may be defined as a radius of a circle that mathematically closest fits the surface at the given point 'P'.

More optionally, for the light-emitting capacitor (LEC) device, at the given point 'P' on the surface of the at least one of the regions, the major principal radius of curvature '$k_1$' is in a range of 1 mm to 100 mm and the minor principal radius of curvature '$k_2$' is in a range of 1 mm to 100 mm.

Yet more optionally, for the light-emitting capacitor (LEC) device, at the given point 'P' on the surface of the at least one of the regions, the major principal radius of curvature '$k_1$' is in a range of 1 mm to 10 mm and the minor principal radius of curvature '$k_2$' is in a range of 1 mm to 10 mm.

Optionally, for the light-emitting capacitor (LEC) device, one or more layers of the multi-layer structures disposed onto a substrate layer have a thickness in a range of 1 μm to 100 μm thick, and more optionally, in a range of 5 μm to 50 μm thick.

Optionally, for the light-emitting capacitor (LEC) device, each of the light-emitting layers includes one or more layers of a light-emitting material. The light-emitting material typically includes a host material and an activator. The host material emits light when excited by application of an alternating electric field thereto, while the activator prolongs a time period during which light is emitted from the host material.

The host material is optionally, for example, an oxide, a nitride, an oxynitride, a sulfide, a selenide, a halide or a silicate of Zinc, Cadmium, Manganese, Aluminium, Silicon, or a suitable rare-earth metal. The activator is optionally, for example, a metal, such as Copper, Silver, Manganese and Zinc. For example, the light-emitting material is optionally Copper-activated Zinc Sulphide (ZnS:Cu), Silver-activated Zinc Sulphide (ZnS:Ag), or Manganese-activated Zinc Sulphide (ZnS:Mn). These light-emitting materials are often referred to as "phosphors".

Optionally, for the light-emitting capacitor (LEC) device, each of the light-emitting layers includes one or more layers of a light-emitting material suspended within a binder material. More optionally, for the electroluminescent device, each of the light-emitting layers includes one or more layers of phosphor crystals suspended within a polymeric binder material.

Optionally, for the light-emitting capacitor (LEC) device, at least one of the plurality of electrode layers is partially transparent, and includes at least one of: transparent conducting oxides, including Indium Tin Oxide (ITO) and/or Indium Zinc Oxide (IZO); graphene; conductive polymer composites, including PEDOT-PSS; metallic nanowires, including Silver nanowires and/or Carbon nanowires; or any combination of these materials, including, for example, metallic nanowires in combination with a conductive polymer composite.

Optionally, for the light-emitting capacitor (LEC) device, at least one of the plurality of electrode layers includes at least one of: Aluminium, Silver, and/or a composite layer including Aluminium, Silver or Carbon particles dispersed in a binder material.

Optionally, for the light-emitting capacitor (LEC) device, at least one layer of the multi-layer structures includes a dielectric layer. Optionally, the dielectric layer includes one or more layers of a material with a high dielectric constant, including, for example, barium titanate (BaTiO3). Optionally, the dielectric layer is at least partially transparent. Optionally, a high dielectric constant is to be considered as corresponding to a relative permittivity $\varepsilon_r$ greater than 10, and more optionally to a relative permittivity $\varepsilon_r$ greater than 50.

Optionally, for the light-emitting capacitor (LEC) device, at least one layer of the multi-layer structures includes a substrate layer. Optionally, the substrate layer includes at least one of the following materials: glass; plastic, including polyethylene teraphthalate (PET), polyethylene naphthalate (PEN), polystyrene (PS), acrylonitrile butadiene styrene (ABS), and/or polycarbonate; metal, including aluminium foil and/or steel foil; paper and/or fabric.

Optionally, for the light-emitting capacitor (LEC) device, at least one of the multi-layer structures includes:

(i) an at least partially transparent substrate layer;
(ii) an at least partially transparent first electrode layer adjacent to the substrate layer;
(iii) a light-emitting layer adjacent to the first electrode layer;
(iv) a dielectric layer adjacent to the light-emitting layer, and
(v) a counter electrode layer adjacent to the dielectric layer.

Optionally, for the light-emitting capacitor (LEC) device, at least one of the multi-layer structures includes:

(i) an at least partially transparent substrate layer;
(ii) an at least partially transparent first electrode layer adjacent to the substrate layer;
(iii) an at least partially transparent dielectric layer adjacent to the first electrode layer;
(iv) a light-emitting layer adjacent to the dielectric layer; and
(v) a counter electrode layer adjacent to the light-emitting layer.

Optionally, for the light-emitting capacitor (LEC) device, at least one of the multi-layer structures includes:

(i) a substrate layer,
(ii) a first electrode layer adjacent to the substrate layer;
(iii) a dielectric layer adjacent to the first electrode layer;
(iv) a light-emitting layer adjacent to the dielectric layer; and
(v) an at least partially transparent counter electrode layer adjacent to the light-emitting layer.

Optionally, for the light-emitting capacitor (LEC) device, at least one of the multi-layer structures includes:

(i) a substrate layer,
(ii) a first electrode layer adjacent to the substrate layer;
(iii) a light-emitting layer adjacent to the first electrode layer;
(iv) an at least partially transparent dielectric layer adjacent to the light-emitting layer; and
(v) an at least partially transparent counter electrode layer adjacent to the dielectric layer.

According to a second aspect, there is provided a method of manufacturing the light-emitting capacitor (LEC) device pursuant to the aforesaid first aspect. At a first step, layers of electrode material, dielectric material and light-emitting material are deposited to form a multi-layer structure. During the first step, one or more of the layers are at least partially dried or cured through application of heat or ultraviolet light, before a subsequent layer is added thereto.

At a second step, heat is applied to the multi-layer structure to soften one or more of the layers. Subsequently, at a third step, a non-planar moulding surface is applied to the softened multi-layer structure to form one or more regions.

These regions have substantial curvatures in two dimensions. One or more light-emitting layers, within these regions, are operable to emit light in a spatially continuous manner with substantially uniform luminance and chromaticity across the regions.

Optionally, in the method, the non-planar moulding surface has substantial two-dimensional curvature. More optionally, the non-planar moulding surface has a shape pursuant to at least one of: an at least partially hemispherical shape, an at least partially spherical shape, an at least partially spheroid shape, an at least partially saddle shape, or ordered or disordered arrays of any of these shapes. More optionally, in the method, the one or more regions at least partially conform to the non-planar moulding surface.

Optionally, in the method, depositing the layers in the first step includes:

(i) forming an at least partially transparent substrate layer,
(ii) depositing an at least partially transparent first electrode layer adjacent to the substrate layer,
(iii) depositing a light-emitting layer adjacent to the first electrode layer;
(iv) depositing a dielectric layer adjacent to the light-emitting layer, and
(v) depositing a counter electrode layer adjacent to the dielectric layer.

Optionally, in the method, depositing the layers in the first step includes:

(i) forming an at least partially transparent substrate layer,
(ii) depositing an at least partially transparent first electrode layer adjacent to the substrate layer,
(iii) depositing an at least partially transparent dielectric layer adjacent to the first electrode layer,
(iv) depositing a light-emitting layer adjacent to the dielectric layer; and
(v) depositing a counter electrode layer adjacent to the light-emitting layer.

Optionally, in the method, depositing the layers in the first step includes:

(i) forming a substrate layer,
(ii) depositing a first electrode layer adjacent to the substrate layer;
(iii) depositing a dielectric layer adjacent to the first electrode layer,
(iv) depositing a light-emitting layer adjacent to the dielectric layer, and
(v) depositing an at least partially transparent counter electrode layer adjacent to the light-emitting layer.

Optionally, in the method, depositing the layers in the first step includes:

(i) forming a substrate layer;
(ii) depositing a first electrode layer adjacent to the substrate layer;
(iii) depositing a light-emitting layer adjacent to the first electrode layer,
(iv) depositing an at least partially transparent dielectric layer adjacent to the light-emitting layer; and
(v) depositing an at least partially transparent counter electrode layer adjacent to the dielectric layer.

Optionally, the method includes fabricating the multi-layer structure, at least in part, by employing one or more screen printing processes using printable ink materials.

Optionally, in the method, one or more layers of the multi-layer structure are disposed on a substrate layer to be in a range of 1 μm to 100 μm thick, more optionally in a range of 5 μm to 50 μm thick.

According to a third aspect, there is provided a manufacturing apparatus for manufacturing the electroluminescent device pursuant to the aforesaid first aspect, using the method pursuant to the aforesaid second aspect.

Embodiments of the present disclosure substantially eliminate, or at least partially address, the aforementioned problems in the prior art, and enable fabrication of one or more light-emitting layers within one or more regions that are curved in two dimensions, wherein the light-emitting layers are operable to emit light with substantially uniform luminance and chromaticity across the regions.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Moreover, those in the art will understand that the drawings are not to scale. Wherever possible, like elements have been indicated by identical numbers.

Embodiments of the present disclosure will now be described, by way of example only, with reference to the following diagrams, wherein.

Figure 1:
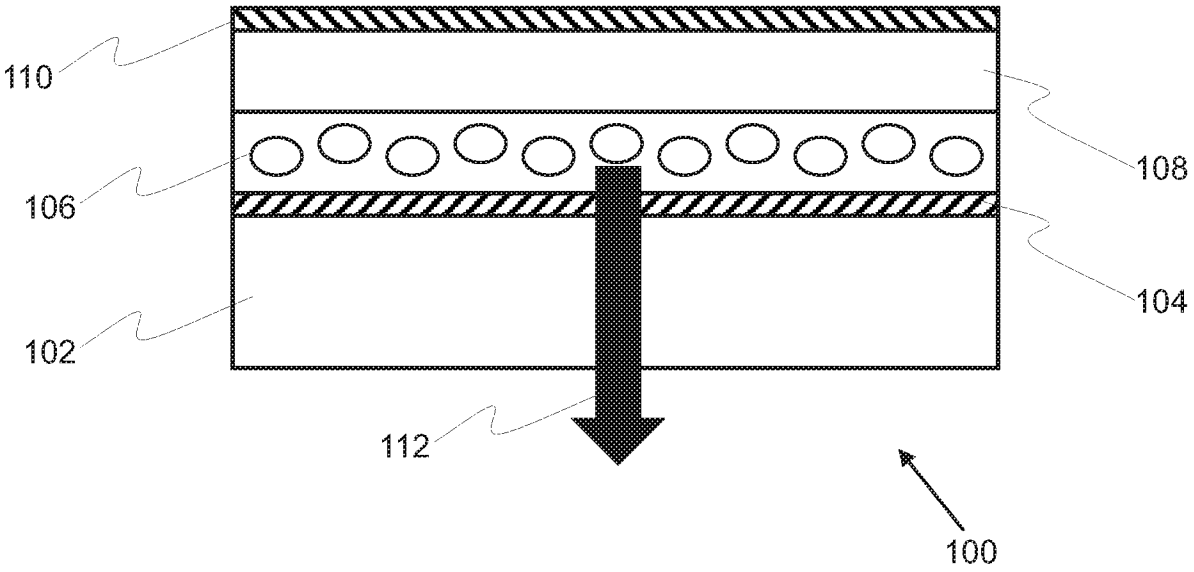
FIG. 1 is a schematic illustration of a multi-layer structure of a region of an electroluminescent device that is operable to emit light when excited by an electric field applied thereto, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although the best mode of carrying out the present disclosure has been disclosed, those skilled in the art would recognize that other embodiments for carrying out or practicing the present disclosure are also possible.

In overview, known electroluminescent devices may be readily manufactured on planar flexible substrates, and may be conformed to form regions with one-dimensional (1D) curvature with relative ease. However, for purposes of demonstrating electroluminescent devices with substantial two-dimensional (2D) curvature, there has previously been required additional patterning processes to pattern light-emitting layers around regions of substantial 2D curvature, use of additional optical components, such as light-extraction blocks and diffuser sheets, or use of spray coating processes that typically result in non-uniform light emission by way of luminance or chromaticity gradients across regions of substantial 2D curvature. The inventor associated with the present disclosure has appreciated that it is highly desirable to demonstrate electroluminescent devices with substantial 2D curvature without the additional patterning processes or the additional optical components of the prior art. Moreover, in view of conventional manufacturing techniques, forming one or more layers of an electroluminescent device, by spraying continuous regions onto three-dimensional surfaces, is not feasible whilst also providing substantially uniform luminance and chromaticity. The present disclosure provides a method of manufacturing electroluminescent devices, and also electroluminescent devices manufactured using the disclosed method.

A conventional problem with electroluminescent devices with layers formed in a planar manner is that subsequent bending or distortion of the layers can cause critical damage to the layers, such that the electroluminescent devices may cease to function, or function with reduced efficiency and/or uniformity. The present disclosure addresses this problem in a novel manner by way of its associated method, wherein the method when employed in manufacture enables an electroluminescent device to be fabricated that is novel and provides enhanced operating features, such as spatially continuous and uniform light emission from surfaces with substantial 2D curvature.

Embodiments of the present disclosure provide a method of manufacturing an electroluminescent device. Moreover, it will be appreciated that various types of devices may be optionally manufactured using the method.

Layers of electrode material, dielectric material and light-emitting material are deposited to form a multi-layer structure. During deposition, one or more of the layers are at least partially dried or cured before one or more additional layers are added thereto. Once the multi-layer structure is formed, heat is applied to the multi-layer structure to soften one or more of the layers; one or more of the layers of the multi-layer structure are then less susceptible to suffering cracking. Thereafter, a non-planar moulding surface having substantial 2D curvature is applied to the softened multi-layer structure. The multi-layer structure at least partially conforms to the non-planar moulding surface to form a region with substantial 2D curvature. A light-emitting layer within the region is operable to emit light in a spatially continuous manner with substantially uniform luminance and/or substantially uniform chromaticity across the region.

The phrase "emit light in a spatially continuous manner" means that there are one or more spatially continuous regions, where photons are generated and emitted, that extend across one or more regions of substantial 2D surface curvature. In other words, there is a continuous path in which photons are generated and emitted across the regions of substantial 2D surface curvature. This creates a contiguous surface light source with 2D curvature, such as a surface light source extending without spaces over a series of mounds and valleys. It is to be noted here that the phrase "emit light in a spatially continuous manner" as defined in this instance excludes non-photo-generating and emitting spaces on a microscopic scale that would not be observable by a standard observer at a distance greater than one meter from the electroluminescent device. In this respect, areas of non-emission from individual spaces between phosphor crystals and dyes that are typically present in thick film electroluminescent (TFEL) devices on a length scale of less than 100 μm are also excluded.

The phrase "substantially uniform luminance" means that luminance measured at a fixed angle to a light-emitting surface is substantially the same across one or more regions with substantial 2D surface curvature. For electroluminescent devices, such as TFEL devices, luminance varies with angle relative to the light-emitting surface. Therefore, for surfaces with substantial 2D curvature, a relative angle must be fixed. In this instance, measurements are taken at a normal incidence to the light-emitting surface at each point. Luminance can be readily measured using a Konica Minolta CS-100a Chroma Meter with 110 close up lens taking measurements at the normal incidence to the light-emitting surface. Luminance Uniformity (LU) in this instance is defined as Lmin/Lmax at the normal incidence to the light-emitting surface at each point. For an electroluminescent device with substantially uniform luminance, LU>80% is preferred, LU>90% is more preferred, and LU>95% is even more preferred. It is to be noted here that the phrase "substantially uniform luminance" as defined in this instance excludes luminance variation on a microscopic scale that would not be observable by a standard observer at a distance greater than one meter from the electroluminescent device. In this respect, variations in luminance emission from individual phosphor crystals and dyes that are typically present in TFEL devices on a length scale of less than 100 μm are also excluded.

The phrase "substantially uniform chromaticity" means that an emission colour is substantially the same across one or more regions with substantial 2D surface curvature. This can be quantified in terms of a metric $\Delta(u', v')=\sqrt{(\Delta u'^2+\Delta v'^2)}$, where $\Delta(u', v')$ is defined as a distance between colour points in Commission Internationale de l'eclairage (CIE) 1976 (u', v') colour space. The CIE 1976 (u', v') colour space is preferred over the CIE 1931 (x, y) colour space, because in the CIE 1976 (u', v') colour space, the distance is approximately proportional to perceived difference in colour. The conversion can be expressed as follows:

$$u'=4x/(-2x+12y+3)$$

$$v'=9y/(-2x+12y+3)$$

For an electroluminescent device with substantially uniform chromaticity, $\Delta(u', v')<0.020$ is preferred, $\Delta(u', v')<0.010$ is more preferred, and $\Delta(u', v')<0.005$ is even more preferred. Chromaticity can be readily measured using a Konica Minolta CS-100a Chroma Meter with 110 close up lens taking measurements at the normal incidence to the light-emitting surface. It is to be noted here that the phrase "substantially uniform chromaticity" as defined in this instance excludes colour variation on a microscopic scale that would not be observable by a standard observer at a distance greater than one meter from the electroluminescent device. In this respect, variations in colour emission from individual phosphor crystals and dyes that are typically present in TFEL devices on a length scale of less than 100 μm are also excluded.

As will be described in greater detail later, the layers of the multi-layer structure are beneficially fabricated, for example, by one or more of following processes: screen printing, slot-die coating, blade coating, spray coating, vapour phase deposition, chemical deposition, sputtering, vacuum thermal evaporation, static accumulation, and/or spin-casting. The layers are beneficially formed in a substantially planar state as this ensures a greater degree of control of layer thickness uniformity, and therefore, device performance uniformity. However, as aforementioned, the region is beneficially curved in at least two dimensions, which optionally requires the layers, after being fabricated as the multi-layer structure, to be shaped to assume a curved form in at least two dimensions, wherein such shaping beneficially does not cause cracking or delamination of any of the layers. Such shaping is beneficially performed immediately after one or more of the layers of the multi-layer structure have been softened, for example, by a thermal heating procedure, namely, whilst the layers are still softened and thereof able to flow and redistribute themselves to reduce stress generation therein during forming.

It will be appreciated to those skilled in the art that the device of the present disclosure is primarily based on LECs, which fundamentally operate on a different principle in contradistinction to other EL light source, such as OLEDs. Specifically, OLEDs allow electric current to flow therethrough, as they operate with bias; however, LECs operate based on charge/discharge cycles. Therefore, for OLEDs, it is possible to maintain substantially uniform luminance across non-uniform layers thereof, as long as the conductivity of such layers is high enough. However, in the case of LECs, the electric field is inversely proportional to a thickness of a light-emitting layer employed, and therefore variation in the thickness of light-emitting layer has a much stronger influence on device performance. Accordingly, the device of the present disclosure, which is primarily based on LECs, includes light-emitting layers essentially having uniform thickness thereacross.

In one example, the non-planar moulding surface optionally has two-dimensional curvature. More optionally, the non-planar moulding surface has a shape pursuant to at least one of: an at least partially hemispherical shape, an at least partially spherical shape, an at least partially spheroid shape, an at least partially saddle shape, or ordered or disordered arrays of any of these shapes. More optionally, in the method, the region at least partially conforms to the non-planar moulding surface.

Consequently, the region beneficially has substantial 2D curvature, such that at a given point 'P' on a surface of the region, a major principal radius of curvature '$k_1$' is preferably in a range of 1 mm to 500 mm, more preferably in a range of 1 mm to 100 mm, and even more preferably in a range of 1 mm to 10 mm; and a minor principal radius of curvature '$k_2$' is preferably in a range of 1 mm to 500 mm, more preferably in a range of 1 mm to 100 mm, and even more preferably in a range of 1 mm to 10 mm. Therefore, such values of '$k_1$' and '$k_2$' provide substantial two-dimensional curvature to the region. The major principal radius of curvature '$k_1$' is defined as a maximum radius of curvature at the given point 'P', while the minor principal radius of curvature '$k_2$' is defined as a minimum radius of curvature at the given point 'P'. At the given point 'P' on the surface, a radius of curvature is defined as a radius of a circle that mathematically best fits a curve of the surface at the given point 'P'.

This would enable the electroluminescent device to attain unique shapes and be used in a range of applications, for example, including custom-made lighting that could be integrated into automotive interiors or exteriors; electronic products, such as domestic appliances, televisions, entertainment devices, computers, cell phones and tablet computers; toys and games; signage; commercial and domestic interior and exterior lighting; and so on. In order to fabricate such a custom-made lighting, the electroluminescent device is optionally used as a mould insert to be integrated into various parts for any of these applications using injection moulding techniques.

In an injection moulding process, a moulding material is heated until it melts, and then injected into a mould, where it cools and hardens to conform to a shape of the mould, to produce a part of a desired shape. The moulding material is optionally, for example, a thermoplastic polymer.

Furthermore, in a first example, the multi-layer structure of the electroluminescent device is optionally manufactured by:

(i) forming an at least partially transparent substrate layer;
(ii) depositing an at least partially transparent first electrode layer adjacent to the substrate layer;
(iii) depositing a light-emitting layer adjacent to the first electrode layer;
(iv) depositing a dielectric layer adjacent to the light-emitting layer; and
(v) depositing a counter electrode layer adjacent to the dielectric layer.

This pertains, for example, to the electroluminescent device being a bottom-emission device, namely, that light may exit the electroluminescent device through the substrate layer. Optionally, the counter electrode layer and/or the dielectric layer may also be at least partially transparent, and in a case where both are at least partially transparent, light may exit the electroluminescent device through both the substrate layer and the counter electrode layer.

In a second example, the multi-layer structure of the electroluminescent device is optionally manufactured by:

(i) forming an at least partially transparent substrate layer;
(ii) depositing an at least partially transparent first electrode layer adjacent to the substrate layer;
(iii) depositing an at least partially transparent dielectric layer adjacent to the first electrode layer;
(iv) depositing a light-emitting layer adjacent to the dielectric layer, and
(v) depositing a counter electrode layer adjacent to the light-emitting layer.

This pertains, for example, to the electroluminescent device being a bottom-emission device, namely, that light may exit the electroluminescent device through the substrate layer. This architecture, where light must pass through the at least partially transparent dielectric layer before exiting the electroluminescent device through the substrate layer, may be advantageous if optical properties of the dielectric layer can be used to tune luminance and/or chromaticity of light emission to a required luminance and/or chromaticity. Optionally, the counter electrode layer may also be at least partially transparent, and in this case, light may exit the electroluminescent device through both the substrate layer and the counter electrode layer.

In a third example, the multi-layer structure of the electroluminescent device is optionally manufactured by:

(i) forming a substrate layer;
(ii) depositing a first electrode layer adjacent to the substrate layer;
(iii) depositing a dielectric layer adjacent to the first electrode layer;
(iv) depositing a light-emitting layer adjacent to the dielectric layer; and
(v) depositing an at least partially transparent counter electrode layer adjacent to the light-emitting layer.

This pertains, for example, to the electroluminescent device being a top-emission device, namely, that light may exit the electroluminescent device through the counter electrode layer. Optionally, the substrate layer, the first electrode layer and/or the dielectric layer may also be at least partially transparent, and in a case where the substrate layer, the first electrode layer and the dielectric layer are at least partially transparent, light may exit the electroluminescent device through both the substrate layer and the counter electrode layer.

In a fourth example, the multi-layer structure of the electroluminescent device is optionally manufactured by:

(i) forming a substrate layer;
(ii) depositing a first electrode layer adjacent to the substrate layer;
(iii) depositing a light-emitting layer adjacent to the first electrode layer;
(iv) depositing an at least partially transparent dielectric layer adjacent to the light-emitting layer; and
(v) depositing an at least partially transparent counter electrode layer adjacent to the dielectric layer.

This pertains, for example, to the electroluminescent device being a top-emission device, namely, that light may exit the electroluminescent device through the counter electrode layer. Such an architecture, where light must pass through the at least partially transparent dielectric layer before exiting the electroluminescent device through the counter electrode layer, may be advantageous if optical properties of the dielectric layer can be used to tune luminance and/or chromaticity of light emission to a required luminance and/or chromaticity. Optionally, the substrate layer and/or the first electrode layer may also be at least partially transparent, and in a case where both are at least partially transparent, light may exit the electroluminescent device through both the substrate layer and the counter electrode layer.

Moreover, one or more layers of the multi-layer structure are optionally fabricated, at least in part, by employing one or more screen printing processes using printable ink materials. However, it will be appreciated that other layers of the multi-layer structure are optionally formed using other processes, for example, by one or more of following processes: slot-die coating, blade coating, spray coating, vapour phase deposition, chemical deposition, sputtering, vacuum thermal evaporation, static accumulation, and/or spin-casting.

Moreover, each layer of the multi-layer structure is optionally disposed onto a substrate layer to be in a range of 1 μm to 100 μm thick, more optionally in a range of 5 μm to 50 μm thick.

Referring now to the drawings, particularly by their reference numbers, FIG. 1 is a schematic illustration of a multi-layer structure 100 of a region of an electroluminescent device that is operable to emit light when excited by an electric field applied thereto, in accordance with an embodiment of the present disclosure. Optionally, the electroluminescent device is a light-emitting capacitor (LEC) device. Optionally, the electroluminescent device is a thick film electroluminescent (TFEL) device.

The multi-layer structure 100 includes a substrate layer 102, a first electrode layer 104 adjacent to the substrate layer 102, a light-emitting layer 106 adjacent to the first electrode layer 104, a dielectric layer 108 adjacent to the light-emitting layer 106, and a counter electrode layer 110 adjacent to the dielectric layer 108. In an alternative embodiment, not shown in FIG. 1, positions of the light-emitting layer 106 and the dielectric layer 108 may be switched.

The substrate layer 102 is optionally at least partially transparent. In some cases, the substrate layer 102 is optionally at least partially transparent to radiation within one radiation wavelength band, while being opaque to other radiation wavelength bands. Beneficially, the substrate layer 102 is optionally at least partially transparent to visible light, namely, the substrate layer 102 optionally allows transmission of visible light through itself.

The substrate layer 102 is optionally, for example, fabricated from any material that is tolerant to moisture, ultraviolet (UV) radiation, abrasion, and natural temperature variations. Examples of such materials include, but are not limited to, glass and plastic, including polyethylene teraphthalate (PET), polyethylene naphthalate (PEN), and polycarbonate.

The first electrode layer 104 is deposited adjacent to a top surface of the substrate layer 102, as shown in FIG. 1. The first electrode layer 104 is optionally deposited, for example, by sputter-deposition, vacuum thermal evaporation, physical vapour deposition (PVD), chemical vapour deposition (CVD), screen printing, slot-die coating, blade coating or spin casting of a first electrode material over the top surface of the substrate layer 102.

The first electrode layer 104 is optionally at least partially transparent. Accordingly, the first electrode material is optionally, for example, a transparent conducting oxide (TCO), such as including Indium Tin Oxide (ITO) or Indium Zinc Oxide (IZO); graphene; a conductive polymer composite, including Poly(3,4-ethylenedioxythiophene) poly (styrenesulfonate) (PEDOT-PSS); metallic nanowires, including Silver nanowires or Carbon nanowires; or any combination of these materials, including, for example, metallic nanowires in combination with a conductive polymer composite. Other conductive polymer materials are optionally employed for the first electrode layer 104.

The light-emitting layer 106 is optionally deposited adjacent to the first electrode layer 104, as shown in FIG. 1. The light-emitting layer 106 is optionally deposited, for example, by screen printing, slot-die coating or blade coating of a light-emitting material over the first electrode layer 104.

The light-emitting material typically includes a host material and an activator. The host material emits light when excited by application of an alternating electric field thereto, while the activator prolongs a time period during which light is emitted from the host material. The host material is optionally, for example, an oxide, a nitride, an oxynitride, a sulfide, a selenide, a halide or a silicate of Zinc, Cadmium, Manganese, Aluminium, Silicon, or a suitable rare-earth metal. The activator is optionally, for example, a metal, such as Copper, Silver, Manganese and Zinc. For example, the light-emitting material is optionally Copper-activated Zinc Sulphide (ZnS:Cu), Silver-activated Zinc Sulphide (ZnS:Ag), or Manganese-activated Zinc Sulphide (ZnS:Mn).

Optionally, the light-emitting material is suspended within a binder material. The binder material optionally binds the light-emitting material together, thereby facilitating a uniform consistency throughout the light-emitting layer 106. Specifically, the light-emitting layer 106 is essentially configured to have uniform thickness thereacross for achieving performance uniformity, namely substantially uniform luminance and chromaticity.

Optionally, the light-emitting layer 106 includes one or more layers of phosphor crystals suspended within a polymeric binder material. More optionally, the light-emitting layer 106 includes three or fewer layers of phosphor crystals suspended within a polymeric binder material.

The dielectric layer 108 is optionally deposited adjacent to the light-emitting layer 106, as shown in FIG. 1. The dielectric layer 108 is optionally deposited, for example, by screen printing, slot-die coating or blade coating of a dielectric material over the light-emitting layer 106. Optionally, the dielectric layer 108 may be at least partially transparent.

Optionally, the dielectric layer 108 includes one or more layers of a material that has a high dielectric constant. For example, the dielectric material is optionally Barium Titanate ($BaTiO_3$). Optionally, a high dielectric constant is to be considered as corresponding to a relative permittivity $\varepsilon_r$ greater than 10, and more optionally to a relative permittivity $\varepsilon_r$ greater than 50.

The counter electrode layer 110 is optionally deposited adjacent to the dielectric layer 108, as shown in FIG. 1. The counter electrode layer 110 is optionally deposited, for example, by sputter-deposition, vacuum thermal evaporation, physical vapour deposition (PVD), chemical vapour deposition (CVD), screen printing, slot-die coating, blade coating or spin casting of a counter electrode material over the dielectric layer 108.

The counter electrode layer 110 is optionally substantially opaque, so that the counter electrode layer 110 optionally does not transmit light therethrough. Accordingly, the counter electrode material is optionally, for example, aluminium, silver or a composite layer including aluminium, silver or carbon particles dispersed in a binder material.

Alternatively, the counter electrode layer 110 is optionally at least partially transparent. Accordingly, the counter electrode material is optionally, for example, a transparent conducting oxide (TCO), such as including Indium Tin Oxide (ITO) or Indium Zinc Oxide (IZO); graphene; a conductive polymer composite, including PEDOT-PSS; metallic nanowires, including Silver nanowires or Carbon nanowires; or any combination of these materials, including, for example, metallic nanowires in combination with a conductive polymer composite. Other conductive polymer materials are optionally employed for the counter electrode layer 110.

Moreover, the multi-layer structure 100 optionally also includes a protective layer (not shown in FIG. 1) over the counter electrode layer 110. The protective layer optionally protects the counter electrode layer 110 from environmental damage, for example protecting against an ingress of moisture and/or against oxidation.

Moreover, the multi-layer structure 100 optionally also includes a protective layer (not shown in FIG. 1) under the substrate layer 102. The protective layer optionally protects the substrate layer 102 from environmental damage, for example protecting against an ingress of moisture and/or against oxidation.

Furthermore, an alternating current (AC) source is optionally connected across the first electrode layer 104 and the counter electrode layer 110. When an alternating current flows, an electric field is applied to the light-emitting layer 106, which then emits light. Specifically, when the alternating current is applied to the first electrode layer 104 and the counter electrode layer 110, an electromagnetic field is created, and this electromagnetic field in turn excites the light-emitting layer 106 layer which produces a luminous energy. Accordingly, the region is optionally arranged for use in such a manner that light emitting from the light-emitting layer 106 passes through the first electrode layer 104 and the substrate layer 102, as depicted by an arrow 112 in FIG. 1. This is optionally a case where the electroluminescent device is a bottom-emission device. As described above, optionally, the dielectric layer 108 and the counter electrode layer 110 may also both be at least partially transparent, and in this case, light may exit the electroluminescent device through both the substrate layer 102 and the counter electrode layer 110.

Moreover, the thickness of the substrate layer 102, and/or the first electrode layer 104 and/or the dielectric layer 108 and/or the counter electrode layer 110 are optionally during manufacture adjusted to allow proper transmission of light emitted by the light-emitting layer 106.

Optionally, the first electrode layer 104 and/or the light-emitting layer 106 and/or the dielectric layer 108 and/or the counter electrode layer 110 have a thickness in a range of 1 μm to 100 μm thick, and more optionally, in a range of 5 μm to 50 μm thick.

FIG. 1 is merely an example, which should not unduly limit the scope of the claims herein. It is to be understood that the specific designation for the multi-layer structure 100 and its various layers is provided as an example and is not to be construed as limiting the multi-layer structure 100 to a specific number, size, shape, type, or arrangement of its layers. A person skilled in the art will recognize many variations, alternatives, and modifications of embodiments of the present disclosure.

For example, the electroluminescent device optionally includes a light-emitting material, such as an organic semiconductor or an organic polymer, for example, including at least one of: polyfluorene, fluorene-based copolymers, polyphenylene vinylene (PPV), polynaphthalene vinylene (PNV), rubrene, and/or copolymers of fluorene and pentacene. For the device, the light-emitting material is optionally deposited over the first electrode layer 104 using, for example, organic vapour phase deposition (OVPD) or inkjet printing.

Moreover, for the device, instead of the dielectric layer 108, a hole-transport layer is optionally deposited over the light-emitting layer 106. The hole-transport layer is optionally deposited using a hole-transport material, for example, including at least one of: polyaniline, polypyrrole, PEDOT and/or PEDOT-PSS. Additionally, the hole-transport material is optionally mixed with other polymer derivatives to improve conductivity and to reduce, for example minimize, degradation of the hole-transport layer.

Furthermore, the colour of light emitted from the light-emitting layer 106 depends on a type of the organic semiconductor or the organic polymer used. Optionally, in order to obtain a multi-colour display in the device, several types of organic semiconductors or organic polymers are used to deposit several light-emitting layers on the same device.

Figure 2:
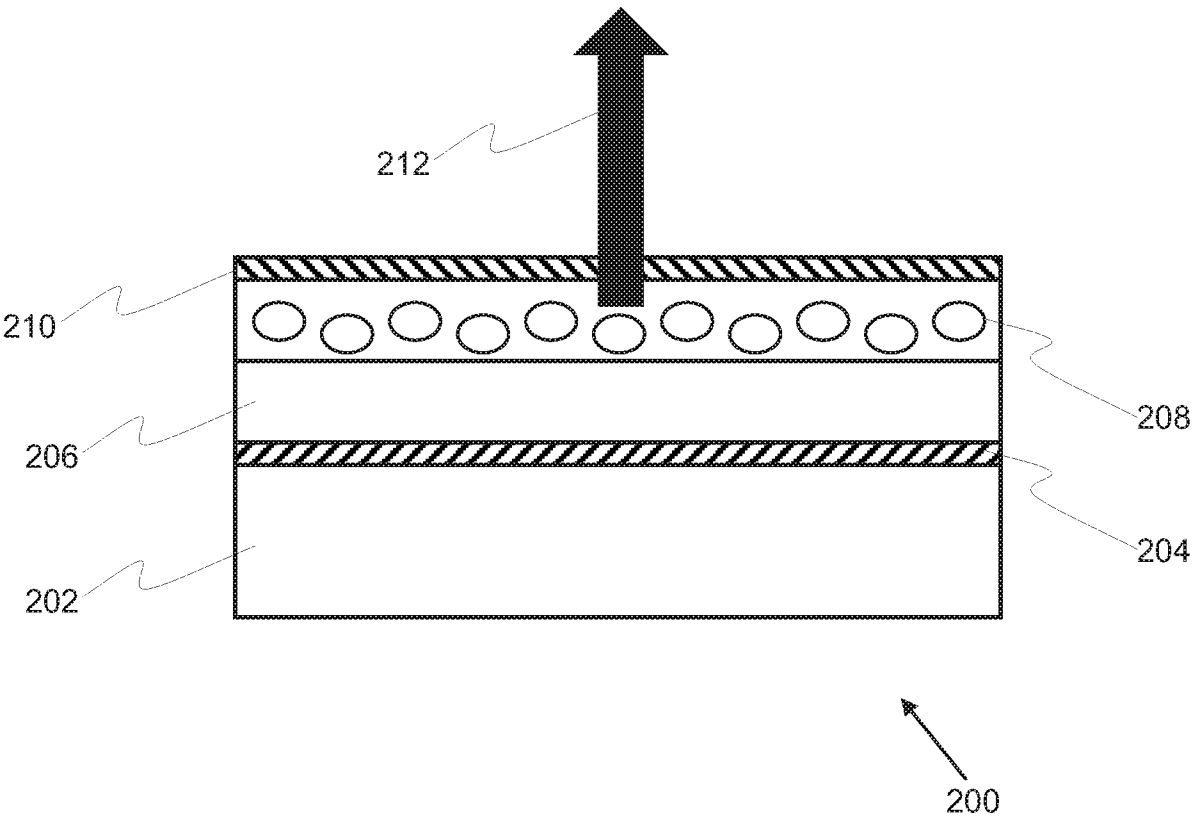
FIG. 2 is a schematic illustration of a multi-layer structure of a region of an electroluminescent device that is operable to emit light when excited by an electric field applied thereto, in accordance with another embodiment of the present disclosure.

Referring next to FIG. 2, there is shown a schematic illustration of a multi-layer structure 200 of a region of an electroluminescent device that is operable to emit light when excited by an electric field applied thereto, in accordance with another embodiment of the present disclosure. Optionally, the electroluminescent device is a light-emitting capacitor (LEC) device. Optionally, the electroluminescent device is a thick film electroluminescent (TFEL) device.

The multi-layer structure 200 includes a substrate layer 202, a first electrode layer 204 adjacent to the substrate layer 202, a dielectric layer 206 adjacent to the first electrode layer 204, a light-emitting layer 208 adjacent to the dielectric layer 206, and a counter electrode layer 210 adjacent to the light-emitting layer 208. In an alternative embodiment, not shown in FIG. 2, positions of the light-emitting layer 208 and dielectric layer 206 may be switched.

The substrate layer 202 is optionally substantially opaque, so that the substrate layer 202 optionally does not transmit light therethrough.

Alternatively, the substrate layer 202 may optionally be at least partially transparent. In some cases, the substrate layer 202 is optionally at least partially transparent to radiation within one radiation wavelength band, while being opaque to other radiation wavelength bands. Beneficially, the substrate layer 202 is optionally at least partially transparent to visible light, namely, the substrate layer 202 optionally allows transmission of visible light through itself.

The substrate layer 202 is optionally, for example, made from any material that is tolerant to moisture, UV radiation, abrasion, and natural temperature variations. Examples of such materials include, but are not limited to, glass; plastic, including polyethylene teraphthalate (PET), polyethylene naphthalate (PEN), polystyrene (PS), acrylonitrile butadiene styrene (ABS), and polycarbonate; metal, including Aluminium foil and steel foil; paper; and fabric.

The first electrode layer 204 is deposited adjacent to a top surface of the substrate layer 202, as shown in FIG. 2. The first electrode layer 204 is optionally deposited, for example, by sputter-deposition, vacuum thermal evaporation, physical vapour deposition (PVD), chemical vapour deposition (CVD), screen printing, slot-die coating, blade coating or spin casting of a first electrode material over the top surface of the substrate layer 202.

The first electrode layer 204 is optionally substantially opaque, so that the first electrode layer 204 optionally does not transmit light therethrough. Accordingly, the first electrode material is optionally, for example, Aluminium, Silver, or a composite layer including Aluminium, Silver or Carbon particles dispersed in a binder material.

Alternatively, the first electrode layer 204 may optionally be at least partially transparent. Accordingly, the first electrode material is optionally, for example, a transparent conducting oxide (TCO), such as including Indium Tin Oxide (ITO) or Indium Zinc Oxide (IZO); graphene; a conductive polymer composite, including PEDOT-PSS; metallic nanowires, including Silver nanowires or Carbon nanowires; or any combination of these materials, including, for example, metallic nanowires in combination with a conductive polymer composite. Other conductive polymer materials are optionally employed for the first electrode layer 204.

The dielectric layer 206 is deposited adjacent to the first electrode layer 204, as shown in FIG. 2. The dielectric layer 206 is optionally deposited, for example, by screen printing, slot-die coating or blade coating of a dielectric material over the first electrode layer 204. Optionally, the dielectric layer 206 may be at least partially transparent.

Optionally, the dielectric layer 206 includes one or more layers of a material that has a high dielectric constant. For example, the dielectric material is optionally Barium Titanate ($BaTiO_3$). Optionally, a high dielectric constant is to be considered as corresponding to a relative permittivity $\varepsilon_r$ greater than 10, and more optionally to a relative permittivity $\varepsilon_r$ greater than 50.

The light-emitting layer 208 is optionally deposited adjacent to the dielectric layer 206, as shown in FIG. 2. The light-emitting layer 208 is optionally deposited, for example, by screen printing, slot-die coating or blade coating of a light-emitting material over the dielectric layer 206.

The light-emitting material typically includes a host material and an activator. The host material emits light when excited by application of an alternating electric field thereto, while the activator prolongs a time period during which light is emitted from the host material. The host material is optionally, for example, an oxide, a nitride, an oxynitride, a sulfide, a selenide, a halide or a silicate of Zinc, Cadmium, Manganese, Aluminium, Silicon, or a suitable rare-earth metal. The activator is optionally, for example, a metal, such as Copper, Silver, Manganese and Zinc. For example, the light-emitting material is optionally Copper-activated Zinc Sulphide (ZnS:Cu), Silver-activated Zinc Sulphide (ZnS:Ag), or Manganese-activated Zinc Sulphide (ZnS:Mn).

Optionally, the light-emitting material is suspended within a binder material. The binder material optionally binds the light-emitting material together, thereby facilitating a uniform consistency throughout the light-emitting layer 208. Specifically, the light-emitting layer 208 is essentially configured to have uniform thickness thereacross for achieving performance uniformity when in operation, namely substantially uniform luminance and chromaticity.

Optionally, the light-emitting layer 208 includes one or more layers of phosphor crystals suspended within a polymeric binder material. More optionally, the light-emitting layer 208 includes three or fewer layers of phosphor crystals suspended within a polymeric binder material.

The counter electrode layer 210 is optionally deposited adjacent to the light-emitting layer 208, as shown in FIG. 2. The counter electrode layer 210 is optionally deposited, for example, by sputter-deposition, vacuum thermal evaporation, physical vapour deposition (PVD), chemical vapour deposition (CVD), screen printing, slot-die coating, blade coating or spin casting of a counter electrode material over the light-emitting layer 208.

The counter electrode layer 210 is optionally at least partially optically transparent. Accordingly, the counter electrode material is optionally, for example, a transparent conducting oxide (TCO), such as including Indium Tin Oxide (ITO) or Indium Zinc oxide (IZO); graphene; a conductive polymer composite, including PEDOT-PSS; metallic nanowires, including Silver nanowires or Carbon nanowires; or any combination of these materials, including, for example, metallic nanowires in combination with a conductive polymer composite. Other conductive polymer materials are optionally employed for the counter electrode layer 210.

Moreover, the multi-layer structure 200 optionally also includes a protective layer (not shown in FIG. 2) over the counter electrode layer 210. The protective layer optionally protects the counter electrode layer 210 from environmental damage, for example against an ingress of moisture and/or against oxidation.

Moreover, the multi-layer structure 200 optionally also includes a protective layer (not shown in FIG. 2) under the substrate layer 202. The protective layer optionally protects the substrate layer 202 from environmental damage, for example against an ingress of moisture and/or against oxidation.

Furthermore, an alternating current (AC) source is optionally connected across the first electrode layer 204 and the counter electrode layer 210. When an alternating current flows, an electric field is applied to the light-emitting layer 208, which then emits light. Accordingly, the region is optionally arranged for use in such a manner that light emitting from the light-emitting layer 208 passes through the counter electrode layer 210, as depicted by an arrow 212 in FIG. 2. This is optionally a case where the electroluminescent device is a top-emission device. As described above, optionally, the substrate layer 202, the first electrode layer 204 and the dielectric layer 206 may also all be at least partially transparent, and in this case, light may exit the electroluminescent device through both the substrate layer 202 and the counter electrode layer 210.

Moreover, the thickness of the substrate layer 202 and/or the first electrode layer 204 and/or the dielectric layer 206 and/or the counter electrode layer 210 are optionally during manufacture adjusted to allow proper transmission of light emitted by the light-emitting layer 208.

Optionally, the first electrode layer 204 and/or the dielectric layer 206 and/or the light-emitting layer 208 and/or the counter electrode layer 210 have a thickness in a range of 1 μm to 100 μm thick, and more optionally, in a range of 5 μm to 50 μm thick.

FIG. 2 is merely an example, which should not unduly limit the scope of the claims herein. It is to be understood that the specific designation for the multi-layer structure 200 and its various layers is provided as an example and is not to be construed as limiting the multi-layer structure 200 to a specific number, size, shape, type, or arrangement of its layers. A person skilled in the art will recognize many variations, alternatives, and modifications of embodiments of the present disclosure.

For example, the electroluminescent device employs, instead of the dielectric layer 206, a hole-transport layer is optionally deposited over the first electrode layer 204. The hole-transport layer is optionally deposited using a hole-transport material, for example, including at least one of: polyaniline, polypyrrole, PEDOT and/or PEDOT-PSS. Additionally, the hole-transport material is optionally mixed with other polymer derivatives to improve conductivity and to reduce, for example to minimize, degradation of the hole-transport layer.

Moreover, for the device, the light-emitting material is optionally an organic semiconductor or an organic polymer, for example, including at least one of: polyfluorene, fluorene-based copolymers, polyphenylene vinylene (PPV), polynaphthalene vinylene (PNV), rubrene, and/or copolymers of fluorene and pentacene. For the device, the light-emitting material is optionally deposited over the hole-transport layer using, for example, organic vapour phase deposition (OVPD) or inkjet printing.

Furthermore, the colour of light emitted from the light-emitting layer 208 depends on a type of the organic semiconductor or the organic polymer used. Optionally, in order to obtain a multi-colour display in the device, several types of organic semiconductors or organic polymers are used to deposit several light-emitting layers on the same device.

Figure 3:
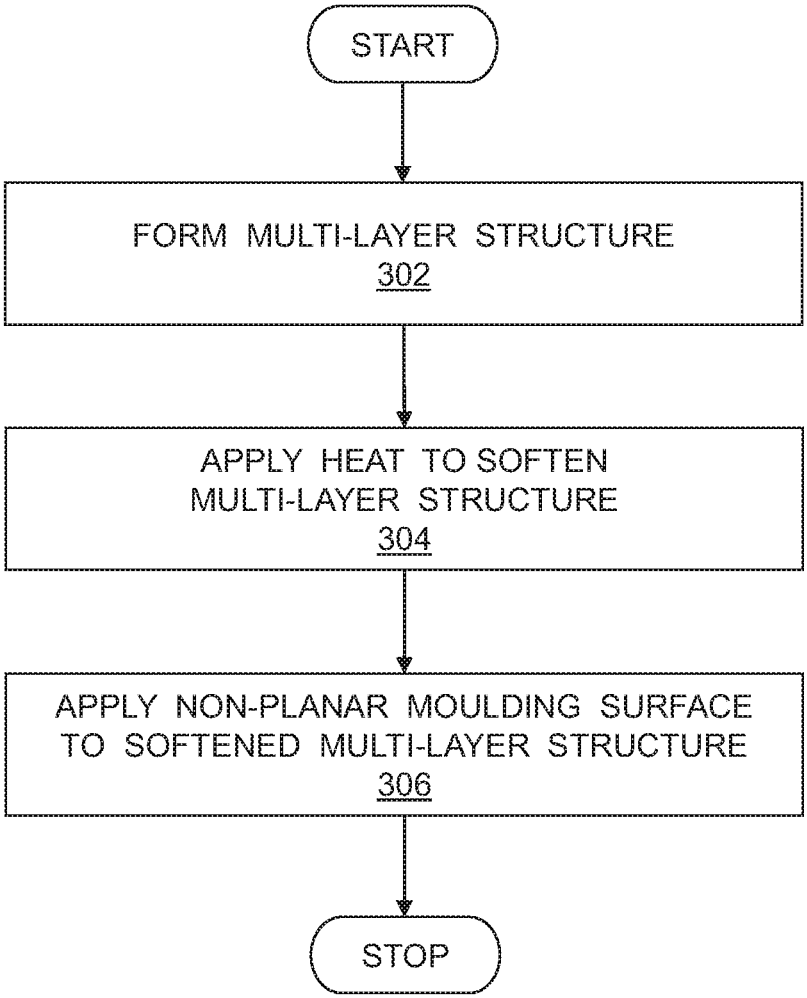
FIG. 3 is an illustration of steps of a method of manufacturing an electroluminescent device including at least one region that is operable to emit light when excited by an electric signal being applied thereto, in accordance with an embodiment of the present disclosure.

FIG. 3 is an illustration of steps of a method of manufacturing an electroluminescent device including at least one region that is operable to emit light when excited by an electric signal being applied thereto, in accordance with an embodiment of the present disclosure. Optionally, the method of manufacturing relates to manufacturing a light-emitting capacitor (LEC) device. Optionally, the method of manufacturing relates to manufacturing a thick film electroluminescent (TFEL) device. The method is depicted as a collection of steps in a logical flow diagram, which represents a sequence of steps that can be implemented in hardware, software, or a combination thereof.

At a step 302, layers of electrode material, dielectric material and light-emitting material are deposited to form a multi-layer structure. During the step 302, each layer is optionally allowed at least partially to dry or be cured before adding a subsequent layer. The step 302 includes multiple sub-steps.

In a first example, the step 302 optionally includes the following sub-steps of:

(i) forming an at least partially transparent substrate layer;
(ii) depositing an at least partially transparent first electrode layer adjacent to the substrate layer;
(iii) depositing a light-emitting layer adjacent to the first electrode layer;
(iv) depositing a dielectric layer adjacent to the light-emitting layer; and
(v) depositing a counter electrode layer adjacent to the dielectric layer.

This is one example of where the electroluminescent device is optionally a bottom-emission device.

In a second example, the step 302 optionally includes the following sub-steps of:

(i) forming an at least partially transparent substrate layer;
(ii) depositing an at least partially transparent first electrode layer adjacent to the substrate layer;
(iii) depositing an at least partially transparent dielectric layer adjacent to the first electrode layer;
(iv) depositing a light-emitting layer adjacent to the dielectric layer; and
(v) depositing a counter electrode layer adjacent to the light-emitting layer.

This is a second example of where the electroluminescent device is optionally a bottom-emission device.

In a third example, the step 302 optionally includes the following sub-steps of:

(i) forming a substrate layer;
(ii) depositing a first electrode layer adjacent to the substrate layer;
(iii) depositing a dielectric layer adjacent to the first electrode layer;
(iv) depositing a light-emitting layer adjacent to the dielectric layer and
(v) depositing an at least partially transparent counter electrode layer adjacent to the light-emitting layer.

This is one example of where the electroluminescent device is optionally a top-emission device.

In a fourth example, the step 302 optionally includes the following sub-steps of:

(i) forming a substrate layer;
(ii) depositing a first electrode layer adjacent to the substrate layer;
(iii) depositing a light-emitting layer adjacent to the first electrode layer;
(iv) depositing an at least partially transparent dielectric layer adjacent to the light-emitting layer; and
(v) depositing an at least partially transparent counter electrode layer adjacent to the dielectric layer.

This is a second example of where the electroluminescent device is optionally a top-emission device.

Optionally, one or more layers of the multi-layer structure are fabricated, at least in part, by employing one or more screen printing processes using printable ink materials. It will be appreciated that other layers of the multi-layer structure are optionally formed using other processes, for example, by one or more of following processes: slot-die coating, blade coating, spray coating, vapour phase deposition, chemical deposition, sputtering, vacuum thermal evaporation, static accumulation, and/or spin-casting.

Optionally, the layers are beneficially formed in a substantially planar state, as described in conjunction with FIGS. 1 and 2. This ensures a greater degree of control of layer thickness uniformity, and therefore, device performance uniformity. For example, the light-emitting layer of the present disclosure is essentially configured to include uniform thickness there-across for achieving performance uniformity when in operation, namely substantially uniform luminance and chromaticity.

Beneficially, one or more layers of the multi-layer structure are optionally fabricated to be in a range of 1 μm to 100 μm thick, more optionally in a range of 5 μm to 50 μm thick.

Next, at a step 304, heat is optionally applied to the multi-layer structure to soften one or more of its layers.

Finally, at a step 306, one or more non-planar moulding surfaces are applied to the softened multi-layer structure to form one or more regions, where one or more light-emitting layers are operable to emit light when excited. The step 306 is optionally, for example, performed using a thermoforming process, such as a vacuum forming process.

In a vacuum forming process, the multi-layer structure is heated to a forming temperature. The forming temperature may be any suitable temperature at which one or more layers of the multi-layer structure may be softened slightly to be able to flow and redistribute themselves to reduce stress generation therein during forming. The forming temperature may beneficially depend on melting points and/or densities of various materials that were used in the formation of the multi-layer structure at the step 302. The softened multi-layer structure is then stretched onto or into a mould, and held against the mould by applying a suitable vacuum pressure between a surface of the mould and the multi-layer structure for a suitable time. Beneficially, the surface of the mould includes a non-planar moulding surface. Optionally, by "suitable time" is meant in an order of seconds or minutes.

In order to best conform to the non-planar moulding surfaces, various materials to be used in the formation of the multi-layer structure at the step 302 are selected in a manner that they have thermal and mechanical expansion properties suited to the thermoforming process.

As aforementioned, the non-planar moulding surfaces have substantial two-dimensional curvatures. Forming of the regions is optionally performed as a single forming procedure using a single moulding surface, or as a series of forming procedures using a sequence of moulding surfaces.

As a result, the one or more regions at least partially conform to the non-planar moulding surface. Consequently, the one or more regions, including the one or more light-emitting layers, have substantial two-dimensional curvature.

In one example, the non-planar moulding surfaces are optionally substantially at least partially hemispherical in shape. In other examples, the non-planar moulding surfaces optionally have shapes that are substantially similar to a shape of at least one of: a sphere, a spheroid, a saddle, and/or an ordered or disordered array of any of these shapes.

Moreover, the one or more light-emitting layers, within the one or more regions formed using the steps 302 to 306, are optionally operable to emit light in a spatially continuous manner with substantially uniform luminance and/or chromaticity across the one or more regions. Beneficially, luminance uniformity measured across a surface of at least one of the one or more regions is greater than 80%, and more optionally, greater than 90%. Variations in chromaticity ($\Delta(u', v')$) measured across the surface are less than 0.02, and more optionally, less than 0.01. The phrases "emit light in a spatially continuous manner", "substantially uniform luminance" and "substantially uniform chromaticity" are defined in more detail in the foregoing.

It should be noted here that the steps 302 to 306 are only illustrative and other alternatives can also be provided where one or more steps are added, one or more steps are removed, or one or more steps are provided in a different sequence without departing from the scope of the claims herein. For example, the method of manufacturing optionally relates to manufacturing an organic light-emitting device. Accordingly, at various sub-steps of the step 302, instead of the dielectric layer, a hole-transport layer is optionally deposited, as described earlier.

Figure 4:
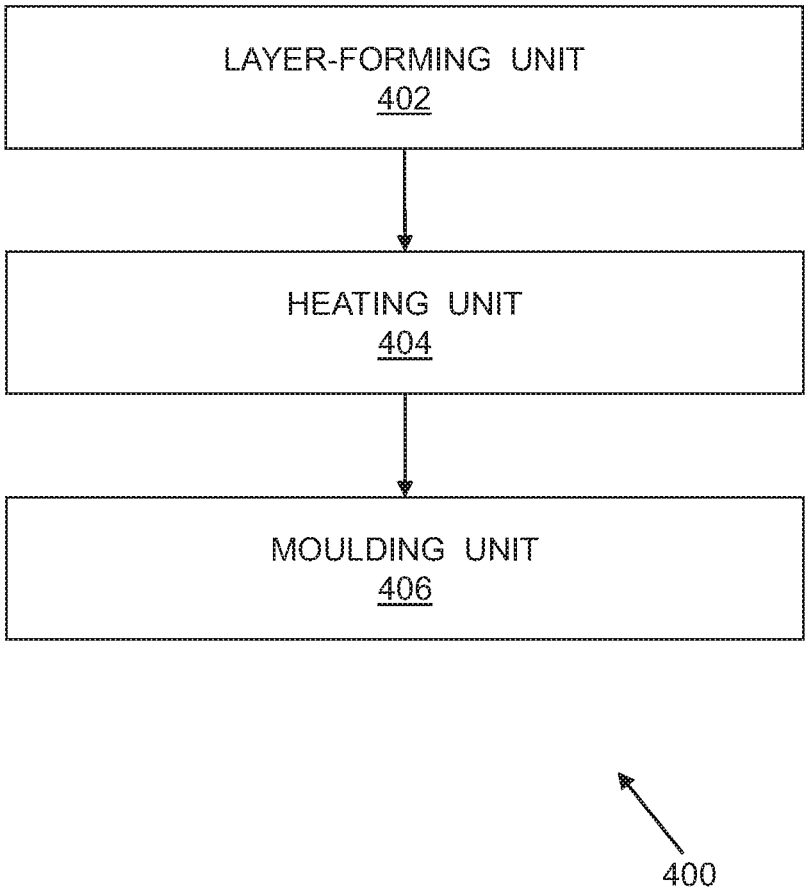
FIG. 4 is a schematic illustration of a manufacturing apparatus for manufacturing an electroluminescent device including at least one region that is operable to emit light when excited by an electric signal being applied thereto, in accordance with an embodiment of the present disclosure.

FIG. 4 is a schematic illustration of a manufacturing apparatus 400 for manufacturing an electroluminescent device including at least one region that is operable to emit light when excited by an electric signal being applied thereto, in accordance with an embodiment of the present disclosure. Optionally, the manufacturing apparatus 400 relates to manufacturing a light-emitting capacitor (LEC) device. Optionally, the manufacturing apparatus 400 relates to manufacturing a thick film electroluminescent (TFEL) device.

The manufacturing apparatus 400 includes a layer-forming unit 402, a heating unit 404, and a moulding unit 406.

The layer-forming unit 402 is configured to deposit layers of electrode material, dielectric material and light-emitting material to form a multi-layer structure. During deposition, one or more of the layers are allowed to at least partially dry or be cured before adding a subsequent layer. The layer-forming unit 402 includes multiple sub-units.

In a first example, the layer-forming unit 402 optionally includes:

(i) a substrate-forming unit configured to form an at least partially transparent substrate layer;
(ii) an electrode-depositing unit configured to deposit an at least partially transparent first electrode layer adjacent to the substrate layer;
(iii) a phosphor-depositing unit configured to deposit a light-emitting layer adjacent to the first electrode layer;
(iv) a dielectric-depositing unit configured to deposit a dielectric layer adjacent to the light-emitting layer; and
(v) a counter-electrode-depositing unit configured to deposit a counter electrode layer adjacent to the dielectric layer.

This is one example of where the electroluminescent device is optionally a bottom-emission device.

In a second example, the layer-forming unit 402 optionally includes:

(i) a substrate-forming unit configured to form an at least partially transparent substrate layer;
(ii) an electrode-depositing unit configured to deposit an at least partially transparent first electrode layer adjacent to the substrate layer;
(iii) a dielectric-depositing unit configured to deposit an at least partially transparent dielectric layer adjacent to the first electrode layer;
(iv) a phosphor-depositing unit configured to deposit a light-emitting layer adjacent to the dielectric layer, and
(v) a counter-electrode-depositing unit configured to deposit a counter electrode layer adjacent to the light-emitting layer.

This is a second example of where the electroluminescent device is optionally a bottom-emission device.

In a third example, the layer-forming unit 402 optionally includes:

(i) a substrate-forming unit configured to form a substrate layer;

(ii) an electrode-depositing unit configured to deposit a first electrode layer adjacent to the substrate layer;

(iii) a dielectric-depositing unit configured to deposit a dielectric layer adjacent to the first electrode layer;

(iv) a phosphor-depositing unit configured to deposit a light-emitting layer adjacent to the dielectric layer, and (v) a counter-electrode-depositing unit configured to deposit an at least partially transparent counter electrode layer adjacent to the light-emitting layer.

This is one example of where the electroluminescent device is optionally a top-emission device.

In a fourth example, the layer-forming unit 402 optionally includes:

(i) a substrate-forming unit configured to form a substrate layer;

(ii) an electrode-depositing unit configured to deposit a first electrode layer adjacent to the substrate layer;

(iii) a phosphor-depositing unit configured to deposit a light-emitting layer adjacent to the first electrode layer;

(iv) a dielectric-depositing unit configured to deposit an at least partially transparent dielectric layer adjacent to the light-emitting layer; and (v) a counter-electrode-depositing unit configured to deposit an at least partially transparent counter electrode layer adjacent to the dielectric layer.

This is a second example of where the electroluminescent device is optionally a top-emission device.

Optionally, one or more layers of the multi-layer structure are fabricated, at least in part, by employing one or more screen printing processes using printable ink materials. It will be appreciated that other layers of the multi-layer structure are optionally formed using other processes, for example, by one or more of following processes: slot-die coating, blade coating, spray coating, vapour phase deposition, chemical deposition, sputtering, vacuum thermal evaporation, static accumulation, and/or spin-casting.

Optionally, the layers are beneficially formed in a substantially planar state, as described in conjunction with FIGS. 1 and 2. This ensures a greater degree of control of layer thickness uniformity, and therefore, device performance uniformity. For example, the light-emitting layer of the present disclosure essentially includes uniform thickness thereacross for achieving performance uniformity when in operation, namely substantially uniform luminance and chromaticity.

Beneficially, one or more layers of the multi-layer structure are optionally fabricated to be in a range of 1 μm to 100 μm thick, more optionally in a range of 5 μm to 50 μm thick.

The multi-layer structure formed at the layer-forming unit 402 is sent to the heating unit 404. The heating unit 404 is configured to apply heat to the multi-layer structure to soften one or more of its layers.

Finally, the softened multi-layer structure is sent to the moulding unit 406. The moulding unit 406 is configured to apply one or more non-planar moulding surfaces to the softened multi-layer structure to form one or more regions, where one or more light-emitting layers are operable to emit light when excited. The moulding unit 406 may, for example, employ a thermoforming process, such as a vacuum forming process, as described earlier.

In order to best conform to the non-planar moulding surfaces, various materials to be used in the formation of the multi-layer structure are selected in a manner that they have thermal and mechanical expansion properties suited to the thermoforming process.

As aforementioned, the non-planar moulding surfaces have substantial two-dimensional curvatures. Forming of the regions is optionally performed as a single forming procedure using a single moulding surface, or as a series of forming procedures using a sequence of moulding surfaces.

As a result, the one or more regions at least partially conform to the non-planar moulding surface. Consequently, the one or more regions, including the one or more light-emitting layers, have substantial two-dimensional curvature.

In one example, the non-planar moulding surfaces are optionally substantially at least partially hemispherical in shape. In other examples, the non-planar moulding surfaces optionally have shapes that are substantially similar to a shape of at least one of: a sphere, a spheroid, a saddle, and/or an ordered or disordered array of any of these shapes.

Moreover, the one or more light-emitting layers, within the one or more regions formed by the manufacturing apparatus 400, are optionally operable to emit light in a spatially continuous manner with substantially uniform luminance and/or chromaticity across the one or more regions. Beneficially, luminance uniformity measured across a surface of at least one of the one or more regions is greater than 80%, and more optionally, greater than 90%. Variations in chromaticity ($\Delta(u', v')$) measured across the surface are less than 0.02, and more optionally, less than 0.01. The phrases "emit light in a spatially continuous manner", "substantially uniform luminance" and "substantially uniform chromaticity" are defined in more detail in the foregoing.

FIG. 4 is merely an example, which should not unduly limit the scope of the claims herein. It is to be understood that the specific designation for the manufacturing apparatus 400 and its various units is provided as an example and is not to be construed as limiting the manufacturing apparatus 400 to a specific number, type, or arrangement of its units. A person skilled in the art will recognize many variations, alternatives, and modifications of embodiments of the present disclosure. For example, the manufacturing apparatus 400 optionally relates to manufacturing an organic light-emitting device. Accordingly, in the layer-forming unit 402, instead of the dielectric-depositing unit, a hole-transport-layer-depositing unit is optionally employed. The hole-transport-layer-depositing unit is optionally configured to deposit a hole-transport layer, pursuant to the device, as described earlier.

It is optionally noted here that various units of the manufacturing apparatus 400 are optionally not necessarily spatially located in proximities of each other. For example, the layer-forming unit 402 is optionally spatially located away from the heating unit 404 and the moulding unit 406. This is, for example, a situation where the multi-layer structure is optionally formed at one manufacturing unit, and is transported to another manufacturing unit for moulding into a suitable shape.

Figure 5:
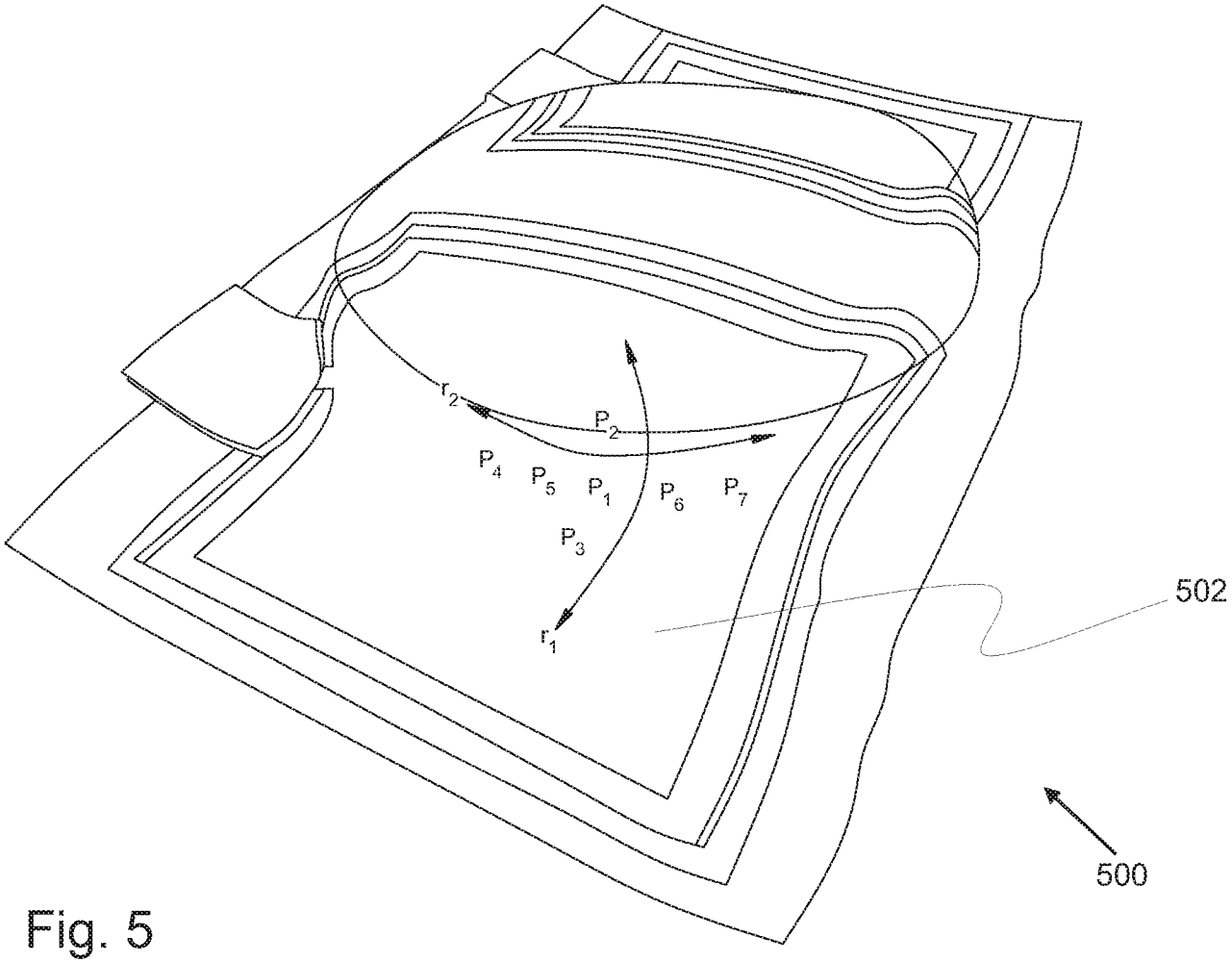
FIG. 5 is an illustration of an example electroluminescent device that includes a region that is operable to emit light when excited by an electric signal being applied thereto, in accordance with an embodiment of the present disclosure.

FIG. 5 is an illustration of an example electroluminescent device 500 that includes a region 502 that is operable to emit light when excited by an electric signal being applied thereto, in accordance with an embodiment of the present disclosure.

The region 502 is optionally formed from a multi-layer structure, for example, by vacuum forming. In the multi-layer structure, a substrate layer is optionally formed from acrylonitrile butadiene styrene (ABS) foil. Optionally, the substrate layer has a thickness in a range of 0.25 mm to 1 mm, and more optionally, in a range of 0.4 mm to 0.6 mm.

In the multi-layer structure, a first electrode layer is deposited over the substrate layer. The first electrode layer is optionally deposited by screen printing of a flexible Silver ink over the substrate layer. Optionally, the first electrode layer is screen printed using a 150 polyester mesh, and then dried in an oven at a temperature of 140° C. for 5 minutes approximately. Optionally, the first electrode layer has a thickness in a range of 5 μm to 50 μm, and more optionally, in a range of 5 μm to 15 μm.

In the multi-layer structure, a dielectric layer is deposited over the first electrode layer. The dielectric layer is optionally deposited by screen printing of a dielectric ink over the first electrode layer. Optionally, the dielectric layer is screen printed using a 120 polyester mesh, such that the dielectric layer substantially covers the region 502 to be lighted, and then dried in the oven at a temperature of 140° C. for 5 minutes approximately. Optionally, the dielectric layer has a thickness in a range of 5 μm to 50 μm, and more optionally, in a range of 10 μm to 20 μm.

In the multi-layer structure, a light-emitting layer is deposited over the dielectric layer. The light-emitting layer is optionally deposited by screen printing of an active phosphor ink over the dielectric layer. Optionally, the light-emitting layer is screen printed using a 120 polyester mesh, such that the light-emitting layer substantially covers the region 502 to be lighted, and then dried in the oven at a temperature of 140° C. for 5 minutes approximately. Optionally, the light-emitting layer has a thickness in a range of 5 μm to 50 μm, and more optionally, in a range of 25 μm to 45 μm. Further, the light-emitting layer beneficially essentially includes uniform thickness thereacross for achieving performance uniformity in operation, namely substantially uniform luminance and chromaticity.

In the multi-layer structure, an at least partially transparent counter electrode layer is deposited over the light-emitting layer. The counter electrode layer is optionally deposited by screen printing of a conductive polymer ink over the light-emitting layer. Optionally, the counter electrode layer is screen printed using a 100 polyester mesh, and then dried in the oven at a temperature of 140° C. for 5 minutes approximately.

In the multi-layer structure, a protective layer is optionally deposited over the counter electrode layer, to encapsulate other layers of the multi-layer structure.

The multi-layer structure so fabricated is then heated in the oven at a temperature of 180° C. for 5 minutes approximately, and then quickly removed from the oven and vacuum formed while still hot over a non-planar moulding surface with substantial two-dimensional curvature. Alignment pins are optionally used to keep the multi-layer structure aligned with the non-planar moulding surface, during vacuum forming. As a result, the region 502 at least partially conforms to the non-planar moulding surface, and has substantial two-dimensional curvature.

This is an example of where the electroluminescent device 500 is optionally a top-emission device.

In order to manufacture a bottom-emission device, the layers of the multi-layer structure can be deposited under similar conditions, but in a reverse order, over an at least partially transparent substrate layer. In this case, the substrate layer can be optionally formed from a PET foil that has a thickness in a range of 0.5 mm to 1.5 mm.

In operation, the light-emitting layer within the region 502 emits light in a spatially continuous manner with substantially uniform luminance and chromaticity across the region 502 that has substantial two-dimensional curvature.

In FIG. 5, there are shown seven points on a surface of the region 502, where luminance and chromaticity measurements were taken, namely, points '$P_1$', '$P_2$', '$P_3$', '$P_4$', '$P_5$', '$P_6$' and '$P_7$'. The point '$P_1$' was taken as a reference point.

A first measurement was taken at the point '$P_1$'. Subsequent measurements were then taken at the points '$P_2$' and '$P_3$' on a path along a major principal radius of curvature '$r_1$' at the point '$P_1$', and at the points '$P_4$', '$P_5$', '$P_6$' and '$P_7$' on a path along a minor principal radius of curvature '$r_2$' at the point '$P_1$'. The measurements are summarized in a table below.

These points were beneficially chosen in a manner that a distance between any two adjacent points was measured to be the same, namely, measured to be 5 mm in this example. Circular discs of different diameters were used to verify that the major principal radius of curvature '$r_1$' was approximately equal to 30 mm and the minor principal radius of curvature '$r_2$' was approximately equal to 12 mm. Therefore, such values of '$r_1$' and '$r_2$' provide substantial two-dimensional curvature to the region 502.

| Point | Path | Luminance [cd/m$^2$] | Chromaticity [(x, y)] | Chromaticity [(u', v')] | ΔLuminance [cd/m$^2$] | ΔChromaticity [Δ(u', v')] |
|---|---|---|---|---|---|---|
| $P_1$ | $r_1$, $r_2$ | 56.0 | (0.167, 0.233) | (0.122, 0.384) | — | — |
| $P_2$ | $r_1$ | 52.3 | (0.165, 0.233) | (0,121, 0.384) | 3.7 | 0.0016 |
| $P_3$ | $r_1$ | 54.3 | (0.165, 0.232) | (0.121, 0.383) | 1.7 | 0.0017 |
| $P_4$ | $r_2$ | 52.5 | (0.165, 0.232) | (0.121, 0.383) | 3.5 | 0.0017 |
| $P_5$ | $r_2$ | 52.9 | (0.165, 0.232) | (0.121, 0.383) | 3.1 | 0.0017 |
| $P_6$ | $r_2$ | 55.6 | (0.166, 0.232) | (0.122, 0.383) | 0.4 | 0.0011 |
| $P_7$ | $r_2$ | 53.4 | (0.166, 0.232) | (0.121, 0.383) | 2.6 | 0.0011 |

In this table, a column 'Point' corresponds to a given point at which a measurement was taken, while a column 'Path' corresponds to a path along a principal radius of curvature on which the given point lies. A column 'Luminance [cd/m$^2$]' corresponds to luminance measured in candela per square meter. A column 'Chromaticity [(x, y)]' corresponds to chromaticity measured in the CIE 1931 (x, y) colour space, while a column 'Chromaticity [(u', v')]' corresponds to chromaticity measured in the CIE 1976 (u', v') colour space. A column 'ΔLuminance [cd/m$^2$]' corresponds to a difference between luminance measured at the given point and the reference point '$P_1$'. A column 'ΔChromaticity [Δ(u', v')]' corresponds to a difference between chromaticity measured at the given point and the reference point '$P_1$'.

From the above measurements, it is evident that luminance of light emission across the surface of the region 502 is substantially uniform, with a maximum variation of 3.7 cd/m$^2$. This corresponds to luminance uniformity >90%. Specifically, the light-emitting layer across the region 502 essentially includes uniform thickness for achieving performance uniformity in operation, namely substantially uniform luminance and chromaticity.

Moreover, it is evident that colour of light emission across the surface is substantially uniform. This can be characterized in terms of chromaticity measured in the CIE 1976 (u', v') colour space, using a metric $\Delta(u', v')=\sqrt{(\Delta u'^2+\Delta v'^2)}$, where $\Delta(u', v')$ is a measure of a distance in the CIE 1976 (u', v') colour space. The CIE 1976 (u', v') colour space is used in preference over the CIE 1931 (x, y) colour space, because in the CIE 1976 (u', v') colour space, the distance is approximately proportional to perceived difference in colour. The chromaticity variations demonstrated in the region 502 lie within 1 MacAdam ellipse of each other. In other words, $\Delta(u', v')<0.0025$, and therefore, no difference in chromaticity can be observed by a standard observer.

In light of the foregoing discussion, it is evident that the light-emitting layer within the region 502 emits light in a spatially continuous manner with substantially uniform luminance and chromaticity across the region 502 that has substantial two-dimensional curvature.

FIG. 5 is merely an example, which should not unduly limit the scope of the claims herein. A person skilled in the art will recognize many variations, alternatives, and modifications of embodiments of the present disclosure.

Embodiments of the present disclosure can be used for various purposes, including, though not limited to, enabling fabrication of a region that is curved in two dimensions, and is operable to emit light with substantially uniform luminosity and chromaticity.

Modifications to embodiments of the present disclosure described in the foregoing are possible without departing from the scope of the present disclosure as defined by the accompanying claims. Expressions such as "including", "comprising", "incorporating", "consisting of", "have", "is" used to describe and claim the present disclosure are intended to be construed in a non-exclusive manner, namely allowing for items, components or elements not explicitly described also to be present. Reference to the singular is also to be construed to relate to the plural.

We claim:

1. A light-emitting capacitor (LEC) device that is operable to emit light from one or more regions thereof, wherein the one or more regions include one or more multi-layer structures comprising one or more light-emitting layers disposed between a plurality of electrode layers, wherein the one or more regions have substantial curvatures in two dimensions and maintain layer thickness uniformity across the regions of curvature, wherein the plurality of electrode layers are operable to receive in operation an excitation signal to apply an electric signal to the one or more light-emitting layers, wherein the one or more light-emitting layers are operable to emit light in a spatially continuous manner with substantially uniform luminance and chromaticity across the one or more regions, wherein a luminance uniformity measured across a surface of at least one of the one or more regions is greater than 80%, and wherein variations in chromaticity ($\Delta(u', v')$) measured across a surface of at least one of the one or more regions are less than 0.02.

2. The electroluminescent device as claimed in claim 1, wherein the light-emitting capacitor (LEC) device is a thick film electroluminescent (TFEL) device.

3. The light-emitting capacitor (LEC) device as claimed in claim 1, wherein at least a portion of the one or more regions has a shape pursuant to at least one of: an at least partially hemispherical shape, an at least partially spherical shape, an at least partially spheroid shape, an at least partially saddle shape.

4. The light-emitting capacitor (LEC) device as claimed in claim 1, wherein at a given point on a surface of at least one of the one or more regions, a major principal radius of curvature '$k_1$' is in a range of 1 mm to 500 mm and a minor principal radius of curvature '$k_2$' is in a range of 1 mm to 500 mm.

5. The light-emitting capacitor (LEC) device as claimed in claim 1, wherein one or more layers of the one or more multi-layer structures have a thickness in a range of 1 μm to 100 μm thick.

6. The light-emitting capacitor (LEC) device as claimed in claim 1, wherein each of the one or more light-emitting layers includes one or more layers of a light-emitting material suspended within a binder material.

7. The light-emitting capacitor (LEC) device as claimed in claim 6, wherein the light-emitting material includes a host material that includes at least one of: an oxide, a nitride, an oxynitride, a sulfide, a selenide, a halide, a silicate of Zinc, Cadmium, Manganese, Aluminium, Silicon, a rare-earth metal.

8. The light-emitting capacitor (LEC) device as claimed in claim 6, wherein the light-emitting material includes an activator that includes at least one of: Copper, Silver, Manganese, Zinc.

9. The light-emitting capacitor (LEC) device as claimed in claim 1, wherein at least one of the plurality of electrode layers is partially transparent, and includes at least one of: transparent conducting oxides, including Iridium Tin Oxide (ITO), Indium Zinc Oxide (IZO); graphene; conductive polymer composites, including PEDOT-PSS; metallic nanowires, including Silver nanowires, Carbon nanowires.

10. The light-emitting capacitor (LEC) device as claimed in claim 1, wherein at least one of the
one or more multi-layer structures includes:
an at least partially transparent substrate layer;
an at least partially transparent first electrode layer adjacent to the substrate layer;
a light-emitting layer adjacent to the first electrode layer;
a dielectric layer adjacent to the light-emitting layer; and
a counter electrode layer adjacent to the dielectric layer.

11. The light-emitting capacitor (LEC) device as claimed in claim 1, wherein at least one of the one or more multi-layer structures includes:
an at least partially transparent substrate layer;
an at least partially transparent first electrode layer adjacent to the substrate layer;
an at least partially transparent dielectric layer adjacent to the first electrode layer;
a light-emitting layer adjacent to the dielectric layer; and
a counter electrode layer adjacent to the light-emitting layer.

12. The light-emitting capacitor (LEC) device as claimed in claim 1, wherein at least one of the one or more multi-layer structures includes:
a substrate layer;
a first electrode layer adjacent to the substrate layer;
a dielectric layer adjacent to the first electrode layer;
a light-emitting layer adjacent to the dielectric layer; and
an at least partially transparent counter electrode layer adjacent to the light-emitting layer.

13. The light-emitting capacitor (LEC) device as claimed in claim 1, wherein at least one of the
one or more multi-layer structures includes:
a substrate layer;
a first electrode layer adjacent to the substrate layer;
a light-emitting layer adjacent to the first electrode layer;
an at least partially transparent dielectric layer adjacent to the light-emitting layer; and an at least partially transparent counter electrode layer adjacent to the dielectric layer.

14. A method of manufacturing an light-emitting capacitor (LEC) device as claimed in claim 1, wherein the method includes:

(a) depositing layers of one or more electrode materials and a light-emitting material, at least partially drying or curing one or more of the layers before adding a subsequent layer thereto, to form a multi-layer structure;

(b) applying heat to the multi-layer structure to soften one or more of the layers; and (c) applying a non-planar moulding surface to the softened multi-layer structure to form one or more regions, wherein the one or more regions have substantial curvatures in two dimensions and maintaining layer thickness uniformity across the regions of curvature, and one or more light emitting layers, within the one or more regions, are operable to emit light in a spatially continuous manner with substantially uniform luminance and chromaticity across the one or more regions.

15. The method as claimed in claim 14, wherein the one or more regions at least partially conform to the non-planar moulding surface, wherein the non-planar moulding surface has a shape pursuant to at least one of: an at least partially hemispherical shape, an at least partially spherical shape, an at least partially spheroid shape, an at least partially saddle shape.

16. The method as claimed in claim 14, wherein one or more layers of the multi-layer structure are disposed onto a substrate layer to be in a range of 1 μm to 100 μm thick.

17. The method as claimed in claim 14, wherein the light-emitting material includes a host material that includes at least one of: an oxide, a nitride, an oxynitride, a sulfide, a selenide, a halide, a silicate of Zinc, Cadmium, Manganese, Aluminium, Silicon, a rare-earth metal.

18. The method as claimed in claim 14, wherein the light-emitting material includes an activator that includes at least one of: Copper, Silver, Manganese, Zinc.

19. The method as claimed in claim 14, wherein the light-emitting material is suspended within a binder material.

20. The method as claimed in claim 14, wherein the one or more electrode materials include at least one of: transparent conducting oxides, including Indium Tin Oxide (ITO), Indium Zinc Oxide (IZO); graphene; conductive polymer composites, including PEDOT-PSS; metallic nanowires, including Silver nanowires, Carbon nanowires.

* * * * *